United States Patent [19]

Uda et al.

[11] 4,087,208

[45] May 2, 1978

[54] METHOD FOR COMPRESSING MIXED GAS CONSISTING OF COMBUSTIBLE GAS AND AIR

[75] Inventors: Kazumi Uda, Fukuyama; Motohiko Tamura, Mihara; Ichiro Nishiura, Takehara; Hiroshi Fujiike, Mihara, all of Japan

[73] Assignee: Mitsubishi Jukogyo Kabushiki Kaisha, Tokyo, Japan

[21] Appl. No.: 693,975

[22] Filed: Jun. 8, 1976

[51] Int. Cl.[2] ..... F04C 19/00

[52] U.S. Cl. ..... 417/54; 417/68

[58] Field of Search ..... 417/68, 69, 54, 55, 417/73, 13, 32

[56] References Cited

U.S. PATENT DOCUMENTS

| | | | |
|---|---|---|---|
| 2,116,939 | 5/1938 | Zahm et al. | 417/68 |
| 2,195,174 | 3/1940 | Jennings | 417/68 |
| 2,771,860 | 11/1956 | Falk | 417/68 X |
| 2,952,214 | 9/1960 | Adams | 417/69 |
| 3,289,918 | 12/1966 | Adams | 417/68 |
| 3,315,879 | 4/1967 | Jennings | 417/69 X |

FOREIGN PATENT DOCUMENTS

| | | | |
|---|---|---|---|
| 1,145,552 | 3/1963 | Germany | 417/68 |

*Primary Examiner*—William L. Freeh
*Assistant Examiner*—Edward Look
*Attorney, Agent, or Firm*—Cushman, Darby & Cushman

[57] ABSTRACT

A novel method for compressing mixed gas consisting of combustible gas and air without risk of explosion of the mixed gas is described herein. In the novel method, the mixed gas is compressed under coexistence of non-combustible liquid such as water. In one preferred embodiment, a water-sealed compressor as represented by a Nash pump is used for compressing the mixed gas, and water contained in the compressed mixed gas is separated and fed back to the water-sealed compressor to assure existence of sealing water in the compressor.

5 Claims, 2 Drawing Figures

METHOD FOR COMPRESSING MIXED GAS CONSISTING OF COMBUSTIBLE GAS AND AIR

Figure 1:
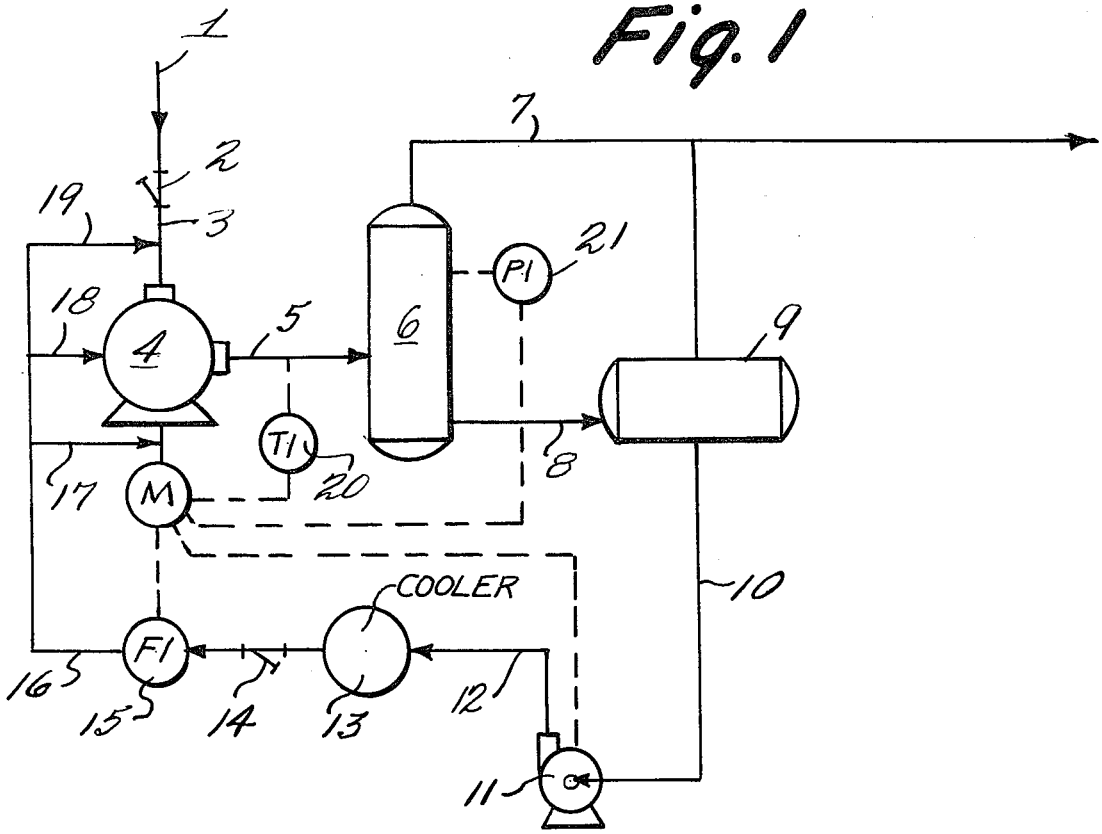

The present invention relates to a method for compressing mixed gas consisting of combustible gas and air without risk of explosion of the mixed gas.

Heretofore, upon compressing mixed gas consisting of combustible gas and air, the compression was effected by means of a compressor of reciprocal or rotary type after the mixed gas had been subjected to the following pre-treatment. This is because in case that said mixed gas has a concentration within explosive limits, it is highly liable to explode due to sparks caused by discharge of electrostatic charge borne by the gas itself, heat generation within the compressor caused by friction of the members of the compressor itself, impact firing caused by abnormal factors, or temperature rise of the gas itself caused by adiabatic compression, unless the mixed gas is subjected to the pre-treatment as described later.

Because of the above-mentioned reasons, a method of compressing mixed gas after it has been subjected to such pretreatment that either the concentration of the combustible gas in the inlet mixed gas is raised higher than the upper limit concentration for explosion by providing a saturator in front of the gas inlet of the compressor of the combustible gas is diluted by non-combustible gas such as nitrogen gas to a concentration lower than the lower limit concentration for explosion, was employed. However, when the mixed gas is subjected to the aforementioned pre-treatment, if the former method is employed, then a saturator becomes necessary, and further, in the case of an apparatus for recovering combustible gas from mixed gas consisting of the combustible gas and air such as, for example, a solvent recovering apparatus, a useless work opposite to recovery is carried out, and so, the method was uneconomical. If the latter method is employed, then a diluting operation becomes necessary, and furthermore, the volume of gas to be treated is enlarged by the amount of the non-combustible gas required for dilution, so that the method was disadvantageous in that the entire apparatus becomes very large and uneconomical. In addition, in case of an apparatus directed to recovery of combustible gas, the recovery was difficult due to the dilution. Still further, in case that the combustible gas concentration in the inlet mixed gas is varying, there was a disadvantage that in order to maintain the diluted concentration constant, the apparatus was more complexed including means for detecting the inlet concentration.

The present invention has been proposed for the purpose of eliminating the above-mentioned disadvantages in the prior art, and the invention provides a method for safely compressing mixed gas consisting of combustible gas and air by compressing said mixed gas under coexistence of non-combustible liquid such as water, without requiring the operation of either raising the combustible gas concentration or lowering the same by dilution.

Figure 2:
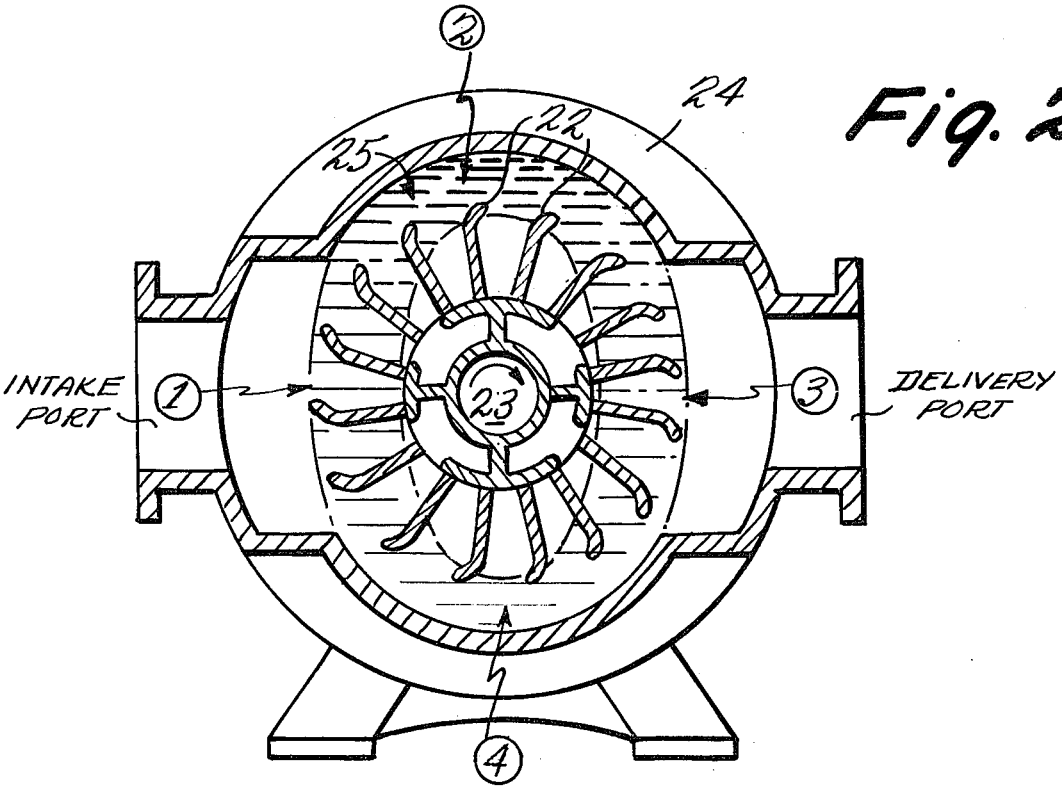

The invention will be described in more detail in connection to its preferred embodiment illustrated in the accompanying drawings, in which:

FIG. 1 is a schematic flow diagram of an apparatus for practicing the method according to the present invention, and FIG. 2 is a schematic cross-section view of a Nash pump to be used as a water-sealed compressor in the apparatus shown in FIG. 1.

Referring now to FIG. 1 of the drawings, mixed gas consisting of combustible gas and air (or oxygen) (hereinafter referred to simply as "mixed gas") is introduced through a piping 1, a strainer 2 and a piping 3 to a water-sealed compressor 4 (for instance, a Nash pump). The strainer 2 is provided for the purpose of preventing mechanical failures caused within the compressor by sucked foreign matters. Explaining now the water-sealed compressor, by way of example, in connection to a Nash pump illustrated in FIG. 2, this pump comprises a rotor 23 having a large number of blades 22 which are forwardly concave on the contrary to a centrifugal pump, and a casing 24 formed in a vertically elongated elliptic shape, and by rotary motion of the rotor 23 liquid 25 within the casing 24 is caused to effect piston actions. Prior to operation, water or other liquid 25 is poured into the casing 24 by about one-half of its volume. Once operation is started, the rotor 23 rotates as rotationally accelerating the liquid 25, so that the liquid 25 within the casing is urged against the inner surface of the casing 24 due to a centrifugal force, resulting in an elliptic water layer along the inner surface of the casing 24. Two adjacent blades 22 of the rotor 23 form a compartment jointly with the opposite side plates of the pump, and as the rotor 23 rotates in the direction of an arrow, the elliptic water layer 25 comes in and out of this compartment as seen in FIG. 2. During the period of rotation from position ① to position ② in FIG. 2, the water layer 25 comes out of said compartment and serves to suck gas, while during the period of rotation from position ② to position ③ in FIG. 2, the water layer 25 comes in said compartment and serves to deliver the sucked gas. Likewise, between the positions ③ and ④ suction is effected, while between the positions ④ and ① delivery is effected. In this way, the water layer 25 operates relative to the blades 22 like a piston in a reciprocal type of pump. In general, at a place where a vacuum pump is used, very frequently liquid is contained in sucked gas, especially in a mist-like form, and even when it is contained in a vapor form it is apt to be liquidized during compression. It is unfavorable to handle such sucked gas with the conventional reciprocal type of vacuum pumps. This is because the liquid would be interposed between a piston and a cylinder cover, and because if a valve or other passages are excessively narrowed by the liquid, resistance to gas is increased, resulting in loss of driving power. However, a Nash pump inherently uses liquid as a piston, and therefore, inclusion of liquid in sucked gas brings about no trouble at all. This is the most important feature of the Nash pump.

In addition, the above-described water-sealed compressor 4 is provided with the following safety measures in structure and in materials. That is, an appropriate clearance is retained between the rotor and the casing and between the rotor and a rotor guide so as to inhibit therebetween, and thereby prevention of generation of an ignition source such as prevention of generation of friction sparks, prevention of seizure and prevention of generation of friction heat, is effected. Furthermore, even in case that the rotor and rotor guide or the casing and rotor should make contact to each other due to any cause, the combination of materials is selected so that sparks or seizure may not likely occur, and for instance, a combination such as a rotor of stainless steel, a rotor guide of copper alloy and a casing of cast steel is selected. Still further, it is also necessary to select the combination of materials taking into account the corrosive nature of the liquid.

The mixed gas introduced into the water-sealed compressor 4 in the above-described manner is compressed, and enters into a gas-liquid separator 6 passing through a piping 5 together with sealing water (Although water is normally used as sealing liquid, other non-combustible liquid can be equally used.). Within the gas-liquid separator 6, the sealing water falls down, while the mixed gas is separated upward through an upper piping 7. This mixed gas is delivered through the piping 7 to the subsequent apparatus (not shown). On the other hand, the sealing water is passed to a sealing water tank 9 via a piping 8 to be held there, and it is further supplied to a pump 11 through a piping 10. This pump 11 is provided for the purpose of circulating the sealing water, and the sealing water pressurized by said pump 11 enters into a sealing water cooler 13 via a piping 12, to be cooled down to a predetermined temperature. The sealing water delivered from the cooler 13 is, after having foreign matters removed by a strainer 14, injected into the compressor 4 through a flow meter 15 and pipings 16, 17, 18 and 19.

Now safety measures taken in the subject apparatus with respect to a flow system, a control system and mechanical strength of the component parts, will be explained. The sealing water to be enclosed within the casing 24 for the purpose of compressing mixed gas with the water-sealed compressor 4, is injected into the casing 24 through the piping 18. In addition, in order to prevent heat generation at a mechanical seal portion, a part of the sealing water is injected into the mechanical seal portion through the piping 17. Still further, in order to make the sealing water spread over the entire inner surface of the compressor 4, especially in order to prevent the sealing water from lacking at the small clearance portions between the rotor, casing and rotor guide, a part of the sealing water is injected into the intake piping line 3 through the piping 19. By injecting the sealing water into the mixed gas through the piping 19 as described above, the mixed gas in brought into a wet state before it enters into the compressor 4, and thereby removal of electrostatic charge can be effectively achieved. Furthermore, even if the mixed gas should be fired within the compressor by any cause, the injected sealing water would extinguish the flame and propagation of flame into the intake piping 1 would be prevented.

As to the safety measures with respect to the control system, the operations of the water-sealed compressor 4 and the sealing water pump 11 are interlocked in such manner that unless the sealing water pump 11 is operated the compressor 4 cannot be operated. In addition, a flow rate of the sealing water through the piping of the sealing water circulation line is detected by means of the flow meter 15, which is interlocked with the water-sealed compressor 4 so that the latter may not be operated unless the flow rate exceeds a predetermined value. The interlocking is also made in such manner that when the flow rate has been reduced lower than said predetermined value during the operation, the compressor 4 may be stopped. In addition, interlocking is made in such manner that the fluid temperature on the delivery side of the water-sealed compressor 4 is detected by means of a thermometer 20 and if abnormal temperature rise should be detected, then the compressor may be stopped, and also that the motor current value of the compressor is detected and if the motor should be abnormally loaded and its current should abnormally exceeds a rating value, then the compressor 4 may be stopped. Pressure indicator 21 measures the pressure of the compressed mixture of combustible gas and air in gas-liquid separator 6 and is interconnected with the motor M of the water-sealed compressor 4 to ensure that the compressor delivers a compressed mixture of combustible gas and air of the required pressure.

As described in detail above, according to the present invention, upon compressing mixed gas consisting of combustible gas and air, the mixed gas is compressed under coexistence of non-combustible liquid such as water, so that very high security is assured and discharge firing caused by electrostatic charge borne by the mixed gas can be prevented in a reliable manner. In addition, according to the present invention, heat generation caused by friction upon compressing the mixed gas, impact sparks caused by abnormal factors, and temperature rise of the mixed gas caused by adiabatic compression or the like can be prevented owing to the direct cooling effect between the mixed gas and the non-combustible liquid such as water. Furthermore, since the mixed gas is compressed by the piston effect of the non-combustible liquid such as water under the state of being wrapped by the non-combustible liquid such as water, it is possible to safely monitor the operation of the apparatus by merely controlling the amount and temperature of the non-combustible liquid such as water. Therefore, the method according to the present invention can result in great advantages when applied to a solvent recovery apparatus, a gasoline vapor recovery apparatus, etc.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A method for compressing mixed gas consisting of combustible gas and air, comprising:

injecting water into said mixed gas, introducing said mixture of mixed gas and water into a water-sealed compressor, injecting water into said water-sealed compressor, and compressing said mixed gas/water mixture, whereby risk of explosion is reduced.

2. A method according to claim 1, in which said water contained in the compressed mixed gas is separated, cooled and fed back to the compressing stage.

3. A method of compressing a mixed gas consisting of combustible gas and air, comprising:

compressing said mixed gas with a water-sealed compressor according to the method of claim 1 to form a mixture of compressed mixed gas and water, separating said mixture of compressed mixed gas and water, and recycling said separated water to said water-sealed compressor.

4. A method according to claim 3, including cooling said recycled water.

5. A method according to claim 3 including collecting said separated water in a tank prior to recycling.

* * * * *

UNITED STATES PATENT OFFICE

CERTIFICATE OF CORRECTION

Patent No. 4,087,208 Dated May 2, 1978

Inventor(s) Kazumi Uda, Motohiko Tamura, Ichiro Nishiura, and Hiroshi Fujiike

It is certified that error appears in the above-identified patent and that said Letters Patent are hereby corrected as shown below:

In the Abstract, line 7, after "Nash", and

Column 2, lines 8, 13, 50 and 53, after "Nash", insert --brand--; and

Column 2, line 1, delete "Nash" and line 2, after "pump" insert --of the kind produced by the Nash Engineering Company under its registered trademark "NASH"--

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*